US011122841B2

(12) United States Patent
Tsuei

(10) Patent No.: US 11,122,841 B2
(45) Date of Patent: Sep. 21, 2021

(54) FACE MASK AND METHOD FOR MANUFACTURING THEREOF

(71) Applicant: Alexander Chieruen Tsuei, Woodbury, MN (US)

(72) Inventor: Alexander Chieruen Tsuei, Woodbury, MN (US)

( * ) Notice: Subject to any disclaimer, the term of this patent is extended or adjusted under 35 U.S.C. 154(b) by 151 days.

(21) Appl. No.: 16/542,594

(22) Filed: Aug. 16, 2019

(65) Prior Publication Data

US 2021/0045481 A1 Feb. 18, 2021

(51) Int. Cl.
*A41D 13/11* (2006.01)

(52) U.S. Cl.
CPC ..... *A41D 13/1107* (2013.01); *A41D 13/1115* (2013.01); *A41D 13/1161* (2013.01)

(58) Field of Classification Search
CPC ..... A41D 13/1107; A41D 13/1115; A41D 13/113; A41D 13/11; A41D 13/1123; A41D 13/1138; A41D 13/1192; A41D 13/1161; A41D 13/1176; A62B 18/02; A62B 23/025; A62B 7/10
See application file for complete search history.

(56) References Cited

U.S. PATENT DOCUMENTS 2,447,450 A * 8/1948 Williams ..... A41D 13/1161 128/206.13
2,751,905 A * 6/1956 Creelman ..... A41D 13/11 128/206.19
3,500,825 A * 3/1970 Andersson ..... A41D 13/11 128/863
4,641,379 A * 2/1987 Martin ..... A41D 13/1161 128/206.28
5,727,544 A * 3/1998 Miura ..... A41D 13/11 128/201.13
5,803,077 A * 9/1998 Gazzara ..... A41D 13/1115 128/205.27
10,960,238 B1 * 3/2021 Reele ..... A62B 18/084
2004/0173216 A1 * 9/2004 Park ..... A62B 23/025 128/206.12
2010/0258130 A1 * 10/2010 Wu ..... A41D 13/1107 128/206.13
2014/0224261 A1 * 8/2014 Tsuei ..... B65D 83/0805 128/863
2015/0173436 A1 * 6/2015 Tsuei ..... A41D 13/1115 2/424
2017/0312558 A1 * 11/2017 Wang ..... A41D 13/1115

FOREIGN PATENT DOCUMENTS

DE 202020103171 U1 * 7/2020 ..... A41D 13/113
WO WO-2011116173 A2 * 9/2011 ..... A41D 13/1107

* cited by examiner

*Primary Examiner* — Amy Vanatta
(74) *Attorney, Agent, or Firm* — Tommy SF Wang; Wang IP Law Group, P.C.

(57) ABSTRACT

The present application discloses a mask including a sheet, a first loop, a second loop and an elastic film. The sheet comprises a central portion, a first lateral portion, a second lateral portion and an opening. The first loop is coupled to the sheet. The second loop is coupled to the sheet. The elastic film is coupled to the sheet and covers the opening. A method of manufacturing the aforementioned face mask is also disclosed.

15 Claims, 16 Drawing Sheets

210
- 211
- 212
- 213
- 214
- 215
  - 215a
  - 215b
  - 215c
  - 215d
- 216
  - 216a
  - 216b
- 217
  - 217a
  - 217b
- 218
  - 218a
  - 218b
- 219
  - 219a
  - 219b

FACE MASK AND METHOD FOR MANUFACTURING THEREOF

TECHNICAL FIELD OF THE INVENTION

The present application generally relates to face masks, and more particularly, to a face mask and a method for manufacturing the face mask.

BACKGROUND OF THE INVENTION

Face masks are useful in a number of fields. For example, in the health care field, a face mask may be useful for protecting both the patient and the health care provider from airborne pathogens or for preventing the transfer of pathogens that reside in the bodily fluids or other liquids. Wearing face masks may also be useful in many industrial settings.

Current face mask comprises a metal nose piece at the nose portion for more stably wearing the face mask onto the wearer according to the shape of the nose. However, such face mask often causes pain and discomfort due to the metal material. In addition, the gaps between the face mask and the nose may be appeared along with the facial muscle movement, resulting in the transfer of pathogens through the gaps.

Therefore, a need remains for a face mask and method of manufacturing the face mask to provide a better fit of the face mask over the wearer nose.

SUMMARY OF THE INVENTION

The present application discloses a face mask and method of manufacturing the face mask to provide a better fit of the face mask over the wearer face.

The mask comprises a sheet, a first loop, a second loop and an elastic film. The sheet comprises a central portion, a first lateral portion, a second lateral portion and an opening. The first loop is coupled to the sheet. The second loop is coupled to the sheet. The elastic film is coupled to the sheet and covers the opening.

In various exemplary embodiments, the opening is semi-elliptical.

In various exemplary embodiments, a widest width of the opening is greater than or equal to 0.25 inches.

In various exemplary embodiments, a longest length of the opening is greater than or equal to 0.25 inches.

In various exemplary embodiments, the sheet further comprises an outer surface and an inner surface, the elastic film is coupled to the inner surface.

In various exemplary embodiments, the elastic film is configured to be stretched in at least one directions. At least one portion of the elastic film has a yield point elongation of greater than or equal to 5% in the at least one direction.

In various exemplary embodiments, an elasticity of the elastic film is less than or equal to 1 psi.

In various exemplary embodiments, the elastic film is extended from the first lateral portion to the second lateral portion.

According to an exemplary embodiment of the face mask, further comprises a first lateral flap coupled to the first lateral portion to form a first chamber; and a second lateral flap coupled to the second lateral portion to form a second chamber. The first lateral flap and the second lateral flap comprise a filtering material or a non-breathable material. An upper most portion of the opening comprises a first end and a second end, a distance between the first lateral flap and the first end is greater than 0 inch, and a distance between the second lateral flap and the second end is greater than 0 inch. The first loop is coupled to the sheet via coupling to the first lateral flap, the second loop is coupled to the sheet via coupling to the second lateral flap. A corner of the first lateral portion closer to the opening and a corner of the second lateral portion closer to the opening are curved.

According to the other exemplary embodiment, the sheet comprises at least one horizontal pleat and at least one vertical pleat. Specifically, the sheet comprises a first vertical pleat, a second vertical pleat, a first horizontal pleat, a second horizontal pleat and a third horizontal pleat, wherein the third horizontal pleat is laid over the first vertical pleat and the second vertical pleat, wherein during an unfolded mode, the first vertical pleat is divided into an upper first vertical pleat and a lower first vertical pleat by the first horizontal pleat and the third horizontal pleat; the second vertical pleat is divided into an upper second vertical pleat and a lower second vertical pleat by the second horizontal pleat and the third horizontal pleat. The first loop is coupled to a first edge of the sheet and the second loop is coupled to a second edge of the sheet.

A method of manufacturing the aforementioned face mask is also disclosed. The method comprises cutting the sheet to form the opening; coupling the elastic film to the sheet; and coupling the first loop and the second loop to the sheet.

According to an exemplary embodiment of the method of manufacturing the face mask, wherein after coupling the elastic film to the sheet, the method further comprises: coupling a first lateral flap to the first lateral portion to form a first chamber; coupling a second lateral flap to the second lateral portion to form a second chamber; and cutting the sheet to make a corner of the first lateral portion closer to the opening and a corner of the second lateral portion closer to the opening be curved.

According to the other exemplary embodiment, wherein after coupling the elastic film to the sheet, the method further comprises pleating the sheet to form a first vertical pleat, a second vertical pleat, a first horizontal pleat, a second horizontal pleat and a third horizontal pleat, wherein the third horizontal pleat is laid over the first vertical pleat and the second vertical pleat, wherein during an unfolded mode, the first vertical pleat is divided into an upper first vertical pleat and a lower first vertical pleat by the first horizontal pleat and the third horizontal pleat; the second vertical pleat is divided into an upper second vertical pleat and a lower second vertical pleat by the second horizontal pleat, and the third horizontal pleat.

Based on the above, the present application allows wearer to have better fit of the face mask over the face since the opening of the sheet and the elastic film can provide a flexible structure for the nose.

In addition, there is no gap between the face mask and cheek since the first chamber and the second chamber may be deformed along with the facial muscle movement. As such, a sealed space is formed between the face mask and the face.

Furthermore, the horizontal pleat and the vertical pleats can create a bigger space for breathing. In addition, a better seal may be formed since the first loop and the second loop are coupled to opposite edges of the sheet. In a worn state, the ear loops may cause upper ends and lower ends of the face mask to be led inward to approximate the face and all edges of the mask to create a better seal.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
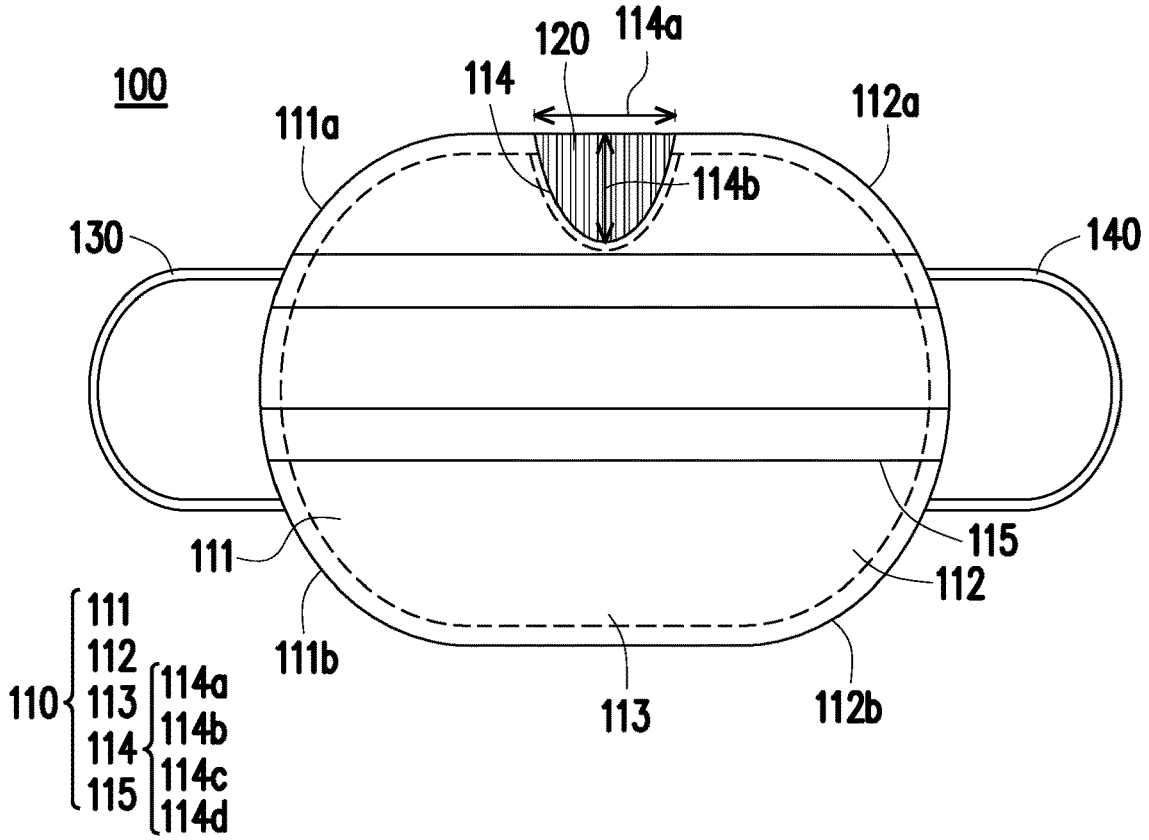
FIG. 1 is a front view of a face mask according to a first embodiment.

Reference will now be made in detail to the present representative embodiments of the present application, examples of which are illustrated in the accompanying drawings. Wherever possible, the same reference numbers are used in the drawings and the description to refer to the same or like parts.

Figure 2:
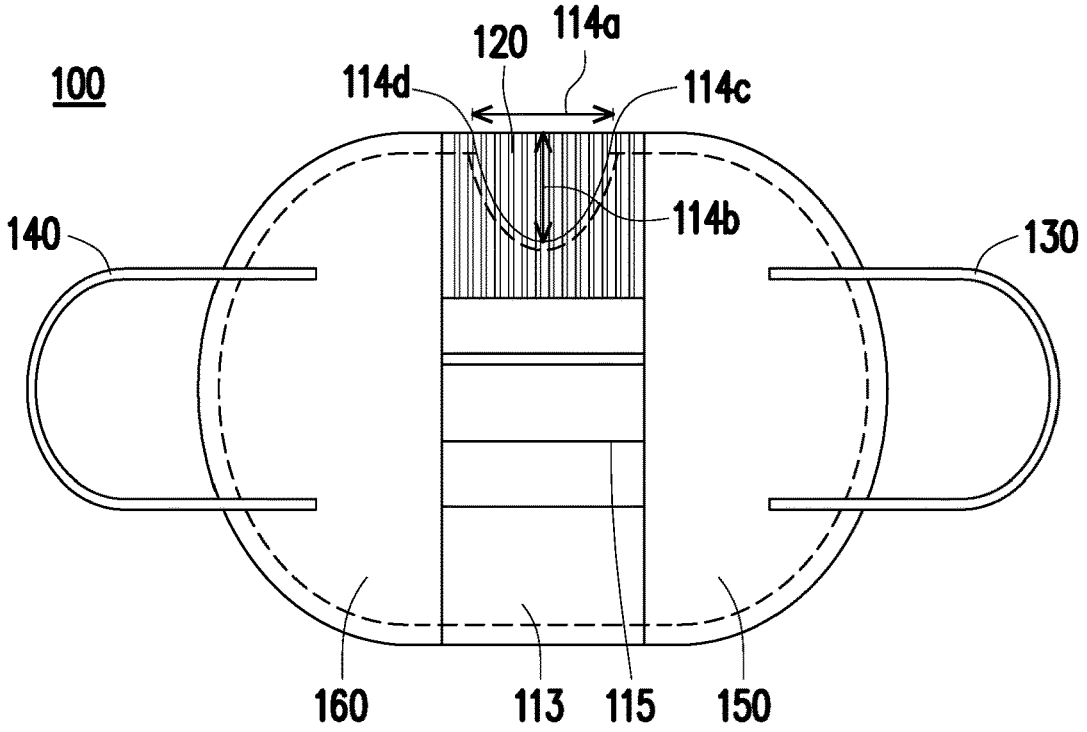
FIG. 2 is a rear view of the face mask according to the first embodiment.

FIG. 1 is a front view of a face mask 100 according to a first embodiment. FIG. 2 is a rear view of the face mask 100 according to the first embodiment.

The face mask 100 comprises a sheet 110, an elastic film 120, a first loop 130, a second loop 140, a first lateral flap 150 and a second lateral flap 160.

The sheet 110 comprises a first lateral portion 111, a second lateral portion 112, a central portion 113, an opening 114 and at least one pleat 115. In addition, the sheet 110 in the present application is a filtering web as an example but is not limited thereto.

The first lateral portion 111 comprises two corners 111*a*/111*b* at a side opposite to the central portion 113. The corner 111*a* is closer to the opening 114 while the corner 111*b* is farther from the opening 114. The second lateral portion 112 comprises two corners 112*a*/112*b* at a side opposite to the central portion 113 as well. The corner 112*a* is closer to the opening 114 while the corner 112*b* is farther from the opening 114. The corner 111*a* and the corner 112*a* are curved. A curved shape is preferred to accommodate requirements of the face masks for peripheral vision and acuity because vision of a face mask is extremely important for performing some tasks, such as computer work, console monitoring, reading, and recognizing peripheral. In addition, the corner 111*b* and the corner 112*b* may also be curved as well, the present application is not limited to the shape of the corner 111*b* and the corner 112*b*.

The opening 114 is located at middle of the sheet 110. Specifically, the opening 114 is located at an upper side of the central portion 113. The shape of the opening 114 in the present application is semi-elliptical as an example. However, the present application is not limited thereto, the opening 114 may be semi-circular, triangular, rectangular or square etc. as long as at least a portion of a nose of a wearer can be exposed via the opening 114. As shown in FIG. 1, the opening 114 comprises an upper most portion 114*a* and a longest portion 114*b*. A width of the upper most portion 114*a* is greater than or equal to 0.25 inches. A longest length of the longest portion 114*b* is greater than or equal to 0.25 inches. It should be noted that the widest portion is not limited at a specific location. The upper most portion 114*a* in the present application is the widest portion of the opening 114 as an example. However, the widest portion can be located anywhere at the opening 114.

FIGS. 1-2 shows that the face mask 100 comprises multiple pleat 115 as an example. However, the present application is not limited, the face mask 100 of the present application may not comprise pleat 115 or may only comprise one pleat 115 as long as the face mask 110 can work functionally.

The elastic film 120 is coupled to the sheet 110 and covers the opening 114. Specifically, the sheet 110 may comprise an outer surface and an inner surface which is faced to the wearer. The elastic film 120 is coupled to the inner surface as an example but is not limited. The elastic film 120 can be coupled to the outer surface of the sheet 110 or any middle layer of the sheet 110 if the sheet 110 is a combination of multiple layers. Furthermore, the elastic film 120 may be extended from the first lateral portion 111 to the second lateral portion 112 (referring to FIG. 3) or only cover the opening 114 (referring to FIG. 12). The present application is not limited thereto. The elastic film 120 can be extended any distance at the face mask 100 as long as the elastic film 120 can cover the opening 114.

The elastic film 120 is stretchable. In detail, the elastic film 120 is configured to be stretched in at least one direction. At least one portion of the elastic film 120 has a yield point elongation (a ratio between increased length and initial length at the yield point) of greater than or equal to 5% in the at least one direction. In addition, an elasticity of the elastic film 120 is less than or equal to 1 psi (pound force per square inch).

Furthermore, the elastic film 120 may be an elastomeric film or an elastomeric laminate.

The elastomeric film can be a mono layer elastomeric film or a multilayer elastomeric film. The elastomeric material of the elastomeric film can be but not limited to olefin-based elastomeric polymer, polyurethane etc.

The elastomeric laminate can be composed of an elastomeric film and an elastic carrier, or be composed of an elastomeric film and a non-elastic carrier in which it needs further conducting the physical or chemical treatment. The carrier includes but not limited to polymer film, fabric, nonwoven fabric, woven fabric, or knitted fabric.

By the structure of the opening 114 and the elastic film 120, the face mask 100 may be better fit onto the wearer's nose. As such, there is no gap appeared between the nose and the face mask 100 since the elastic film 120 is stretchable, preventing fog generation when wearing.

The first loop 130 and the second loop 140 are coupled to the sheet 110. The first loop 130 and the second loop 140 in the present application are ear loops but is not limited thereto. The first loop 130 and the second loop 140 can be manual tie-straps or can be combined as a headband as well.

The detail of the location of the first loop 130 and the second loop 140 will be described with FIGS. 2-4 later.

Figure 3:
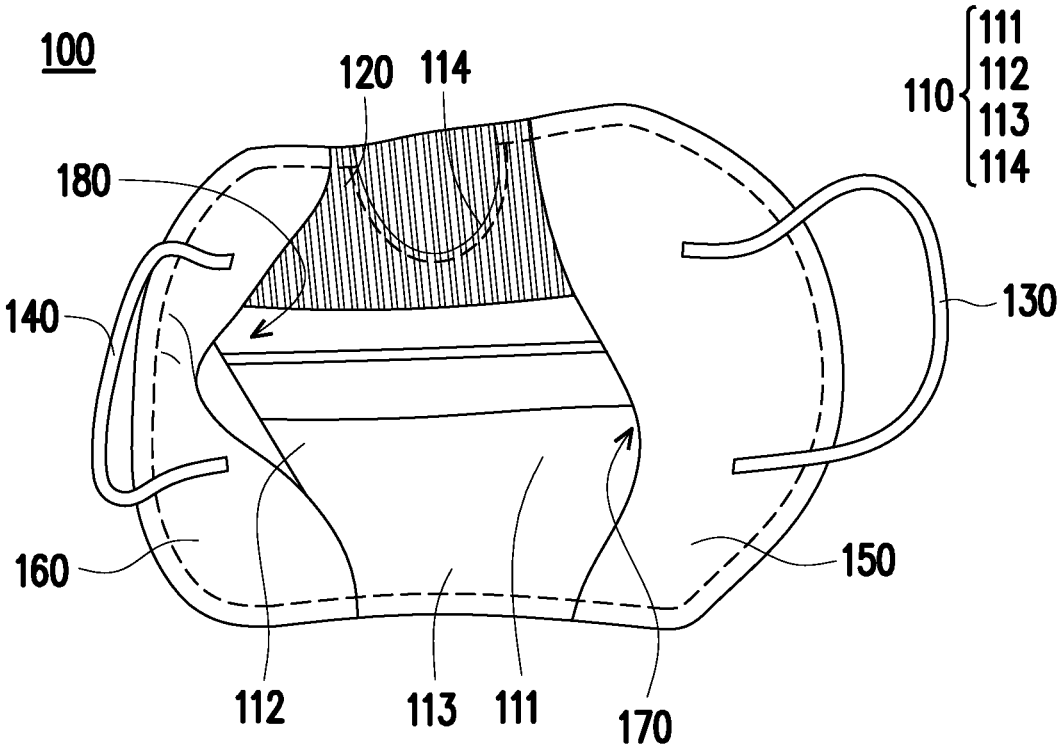
FIGS. 3-4 are views showing a first chamber and a second chamber of the face mask according to the first embodiment.
Figure 4:
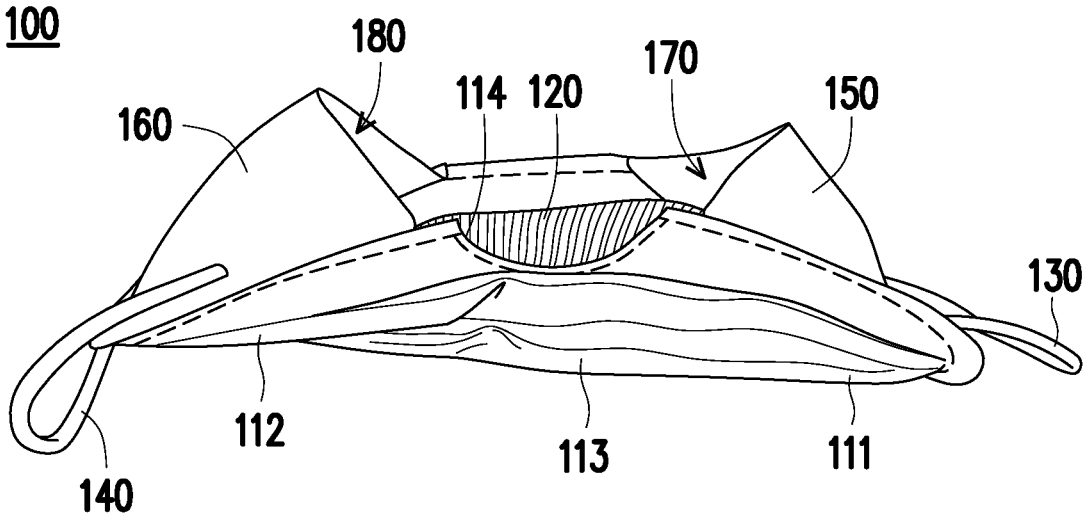

FIGS. 3-4 are views showing a first chamber 170 and a second chamber 180 of the face mask 100 according to the first embodiment.

Referring to FIGS. 2-4, the first lateral flap 150 is coupled to the first lateral portion 111 to form the first chamber 170. The second lateral flap 160 is coupled to the second lateral portion 112 to form the second chamber 180. Therefore, in a worn state, the first loop 130 and the second loop 140 may cause the upper and lower ends of the face mask 100 to be led inward to approximate the face, allowing all edges of the face mask 100 to create a better seal.

As shown in FIG. 2, the widest portion 114*a* of the opening 114 comprises a first end 114*c* and a second end 114*d*. A distance between the first lateral flap 150 and the first end 114*c* is greater than 0 inch. A distance between the second lateral flap 160 and the second end 114*d* is greater than 0 inch.

Corners of the first lateral flap 150 and the second lateral flap 160 may be curved as the first lateral portion 111 and the second lateral portion 112. An inner edge of the first lateral flap 150 and an inner edge of the second lateral flap 160 which are closer to the central portion 113 may have different contour such as linear, concave, convex or irregular etc. The variation in such contour has influence on the degree of contact between the face mask 100 and a corresponding portion of the wearer's face. As such, the contour of the inner edge of the first lateral flap 150 and the edge of the second lateral flap 160 may be modified according to different industry, the present application is not limited thereto.

Although it is not shown in the drawings, the first lateral flap 150 and the second lateral flap 160 may comprise at least one peripheral fold or/and at least one pleat to create enhanced contact between the face mask 100 and a corresponding portion of the wearer's face.

The first lateral flap 150 and the second lateral flap 160 may comprise filtering material or non-breathable material. The non-breathable material can be a polymeric film or a polymeric film with a nonwoven/fabric laminate. However, the present application is not limited thereto as long as the first chamber 170 and the second chamber 180 can be formed.

Figure 5A:
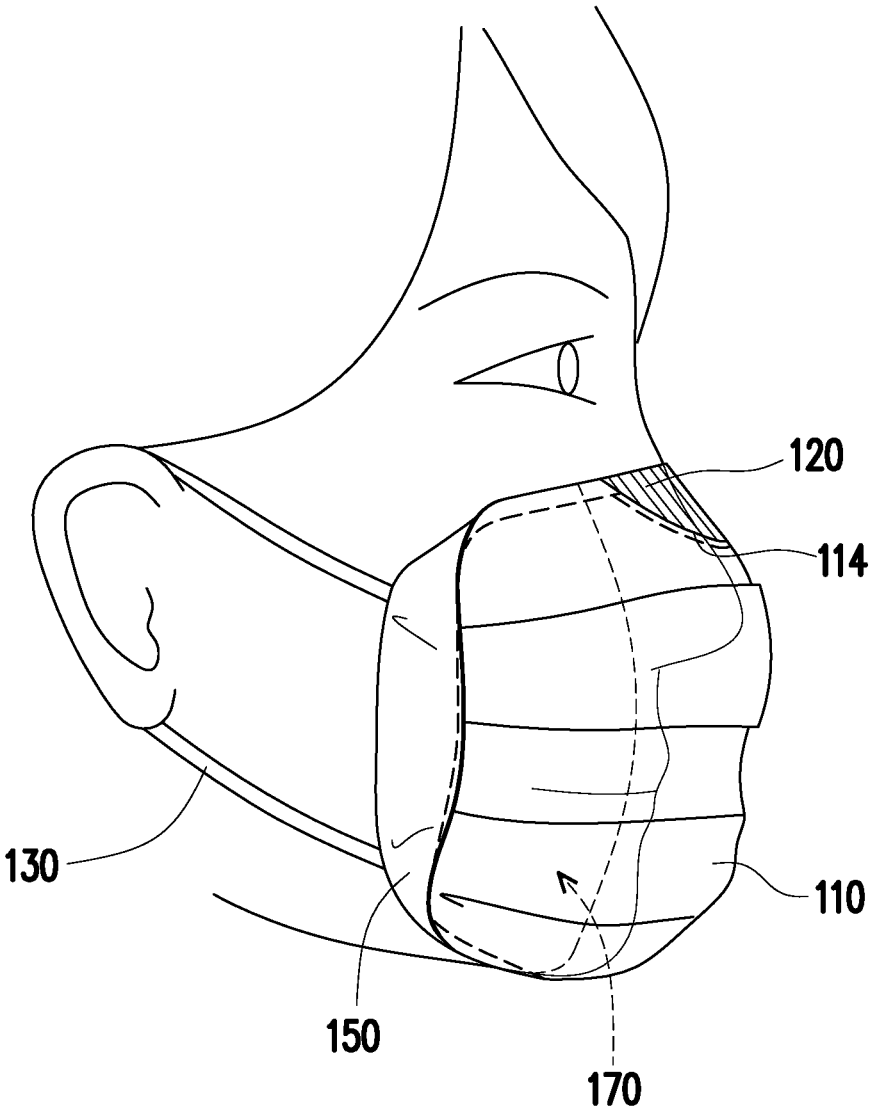
FIGS. 5A-5B are views showing a wearer wears the face mask of the first embodiment.
Figure 5B:
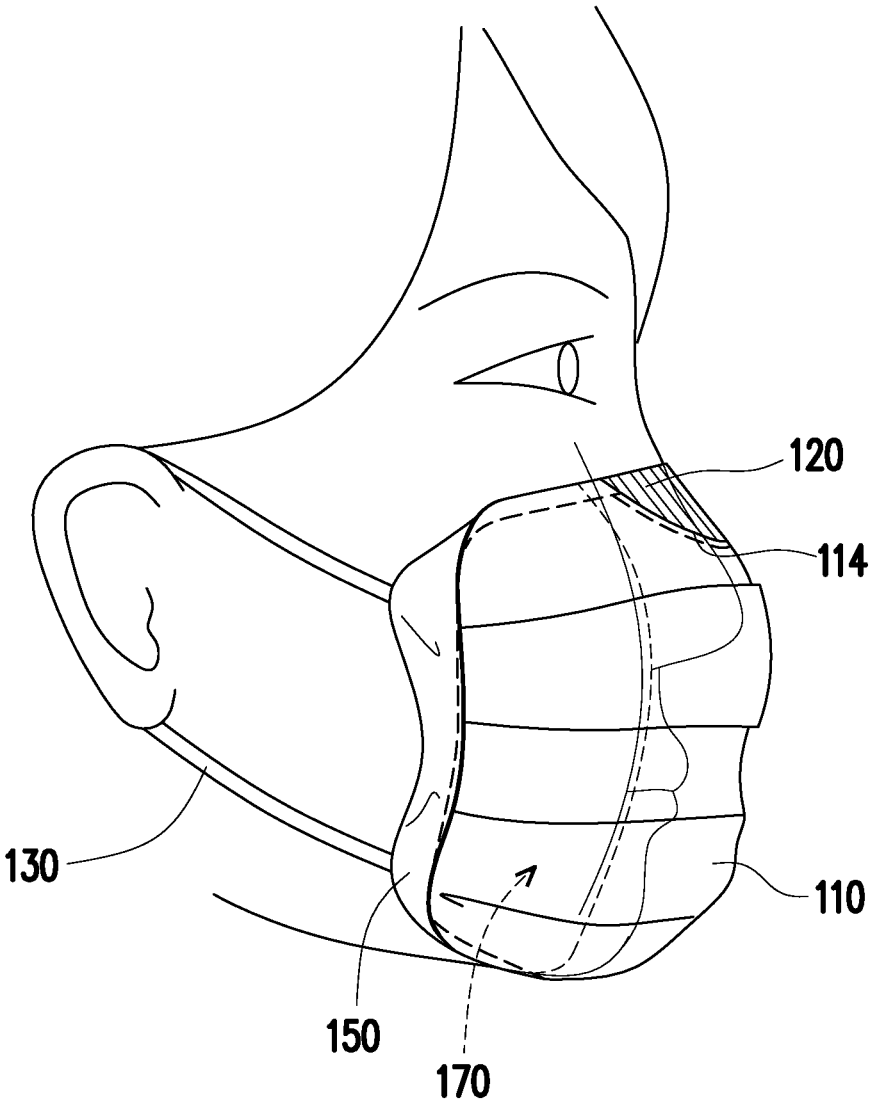

FIGS. 5A-5B are views showing a wearer wears the face mask 100 of the first embodiment.

Referring to FIGS. 2 and 5A-5B, the first loop 130 is coupled to the sheet 110 via coupling to the first lateral flap 150. The second loop 140 is coupled to the sheet 110 via coupling to the second lateral flap 160. By coupling the first loop 130 to the first lateral flap 150 and the second loop 140 to the second lateral flap 160, the first chamber 170 and the second chamber 180 can be formed and deformed along with facial muscle movement when wearing the face mask 100.

By the above structure, there is no gap between the face mask 100 and cheek since the first chamber 170 and the second chamber 180 may be deformed along with the facial muscle movement. As such, a sealed space is formed between the face mask 100 and the face.

Figure 6A:
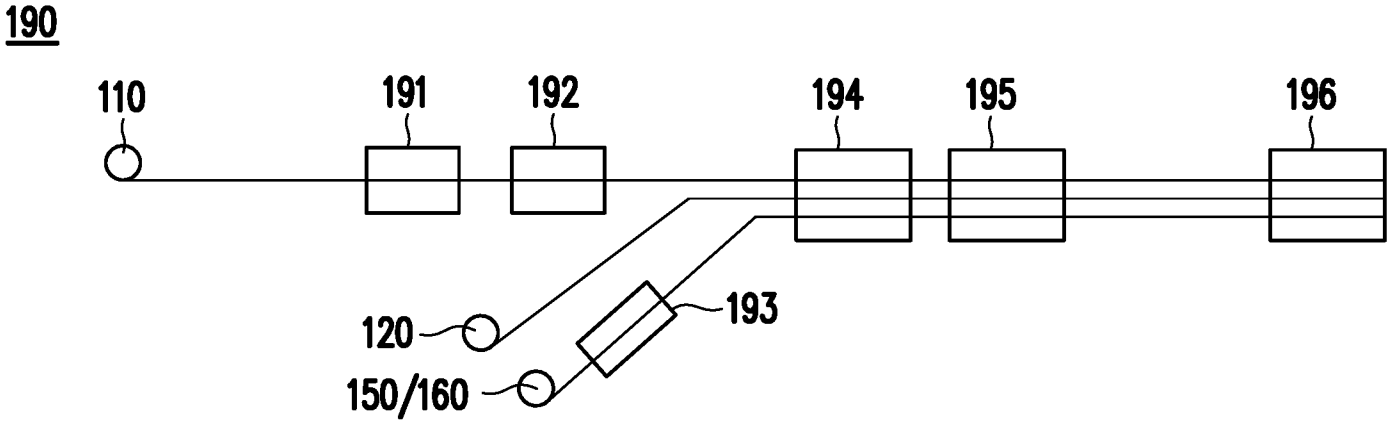
FIGS. 6A-6C are views showing a method of manufacturing the face mask of the first embodiment.
Figure 6B:
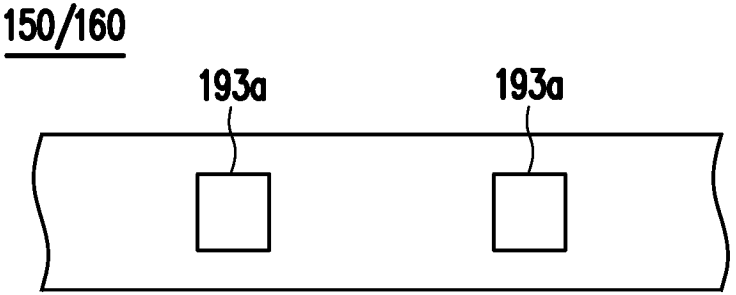
Figure 6C:
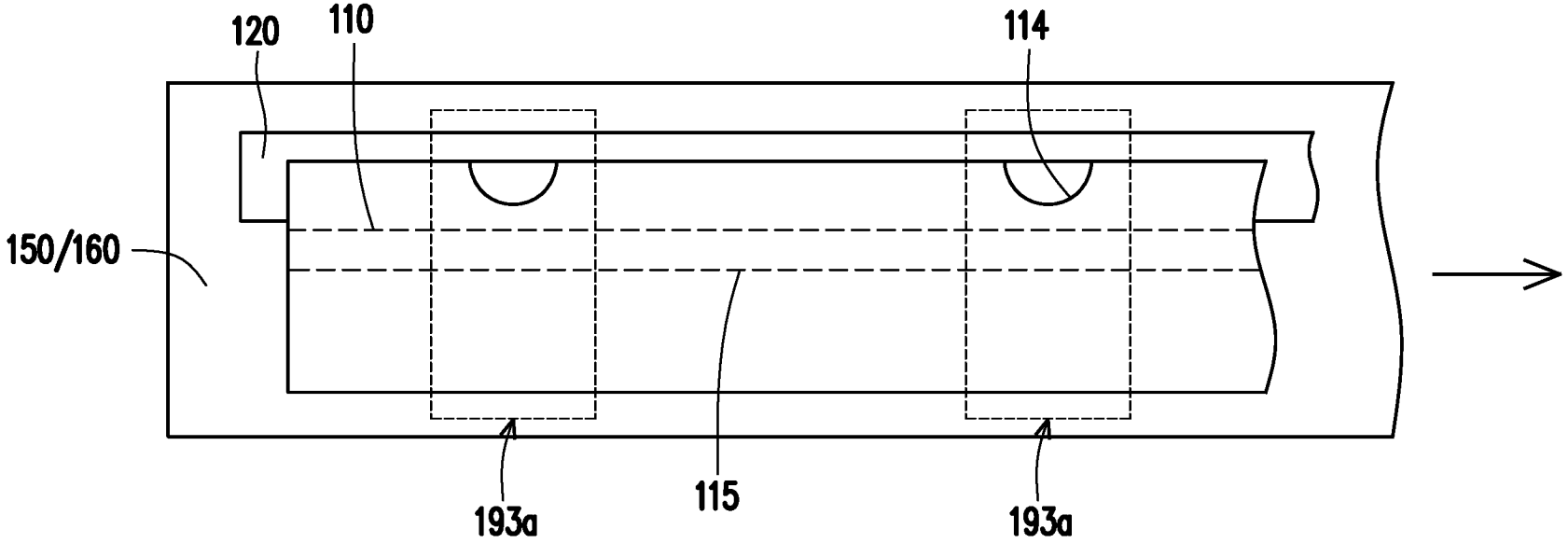

FIGS. 6A-6C are views showing a method of manufacturing the face mask 100 of the first embodiment.

Referring to FIGS. 1 and 6A, a system 190 comprises a pleating station 191, a die-cut station 192, a die-cut station 193, a bonding station 194 and a die-cut station 195.

First, preparing the material of the sheet 110 and passing it to the pleating station 191. However, if the face mask 100 does not comprise the pleat 115, this step may be omitted. Second, cutting the material of the sheet 110 to form the opening 114 via the die-cut station 192.

Next, preparing the material of the elastic film 120 and the material for the first lateral flap 150 and the second lateral flap 160. The material of the elastic film 120 is passed to the bonding station 194. However, it is required for the material for the first lateral flap 150 and the second lateral flap 160 to be passed to the die-cut station 193 before passed to the bonding station 194.

Referring to FIG. 6B, the die-cut station 193 may cut the material for the first lateral flap 150 and the second lateral flap 160 to have at least one open configuration 193*a*. The open configuration 193*a* in FIG. 6B is a rectangular configuration as an example. However, the present application is not limited thereto. The open configuration 193*a* can be any kind of shape according to the contour of the first lateral flap 150 and the second lateral flap 160.

After the above steps, coupling the material of the sheet 110, the material of the elastic film 120 and the material for the first lateral flap 150 and the second lateral flap 160 together via the bonding station 194. The layout of all material is shown in FIG. 6C as an example. A direction of arrow shown in FIG. 6C means the direction of entering the bonding station 194.

Next, cutting the extra material from the material of the sheet 110, the material of the elastic film 120 and the material for the first lateral flap 150 and the second lateral flap 160 via the die-cut station 195. After this step, the finalized shape of the sheet and the elastic film 120 may be created. In addition, the first lateral flap 150 and the second lateral flap 160 are also formed as well.

Last, coupling the first loop 130 to the sheet 110 via coupling the first loop 130 to the first lateral flap 150 and coupling the second loop 140 to the sheet 110 via coupling the second loop 140 to the second lateral flap 160 by the bonding station 196.

Figure 7:
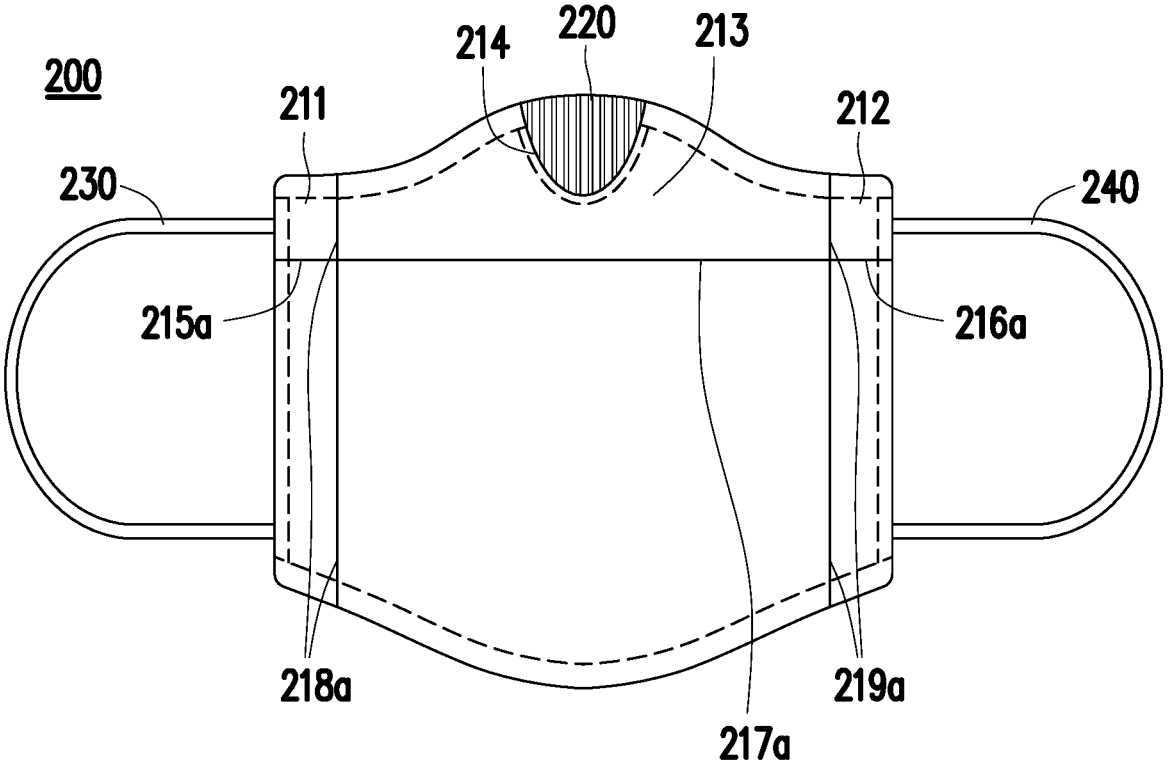
FIG. 7 is a front view of a face mask according to a second embodiment.
Figure 8:
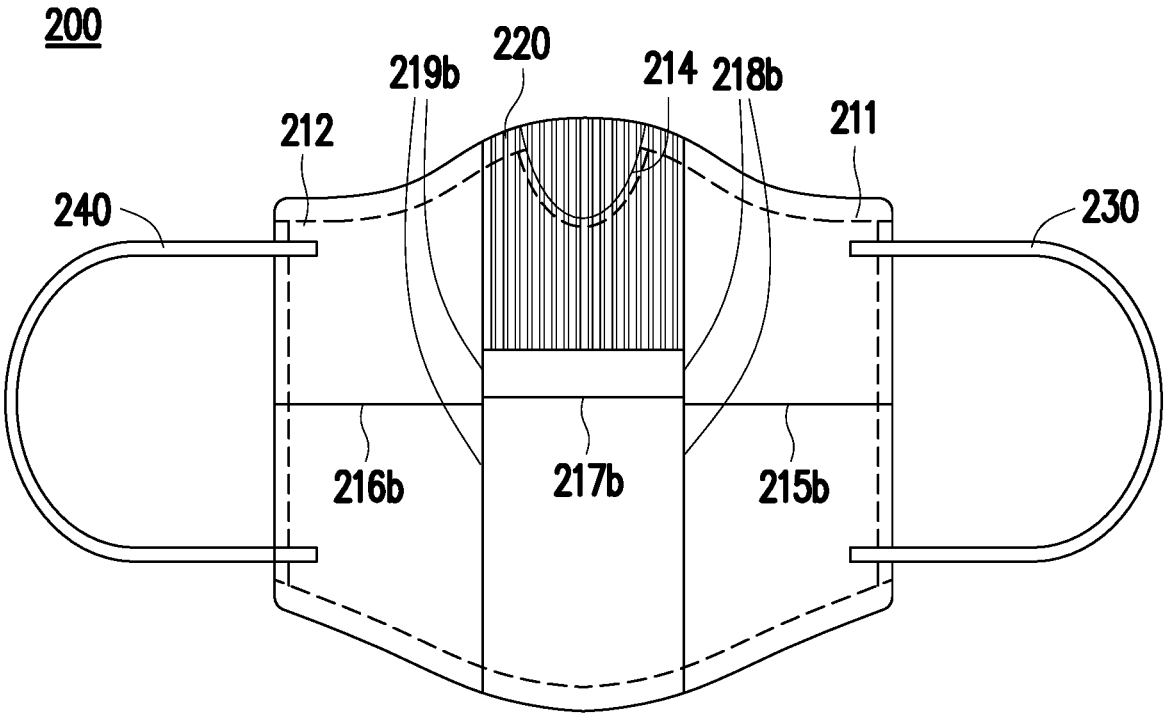
FIG. 8 is a rear view of the face mask according to the second embodiment.

FIG. 7 is a front view of a face mask 200 according to a second embodiment. FIG. 8 is a rear view of the face mask 200 according to the second embodiment.

The face mask 200 comprises a sheet 210, an elastic film 220, a first loop 230, a second loop 240.

The sheet 210 comprises a first edge 211, a second edge 212, a central portion 213, an opening 214, at least one horizontal pleat 215-217 and at least one vertical pleat 218-219.

The first loop 230 is coupled to the first edge 211 and the second loop 240 is coupled to the second edge 212. As such, wearer's face and all edges of the face mask 200 will be closer, creating a better seal (referring to FIG. 13). The first loop 230 and the second loop 240 in the present application are ear loops but is not limited thereto. The first loop 230 and the second loop 240 can be manual tie-straps or can be combined as a headband as well.

The structure of the opening 214 is the same as the opening 114 (referring to FIG. 1) of the face mask 100 (referring to FIG. 1). The elastic film 220 is coupled to the sheet 210 and covers the opening 214.

Figure 9A:
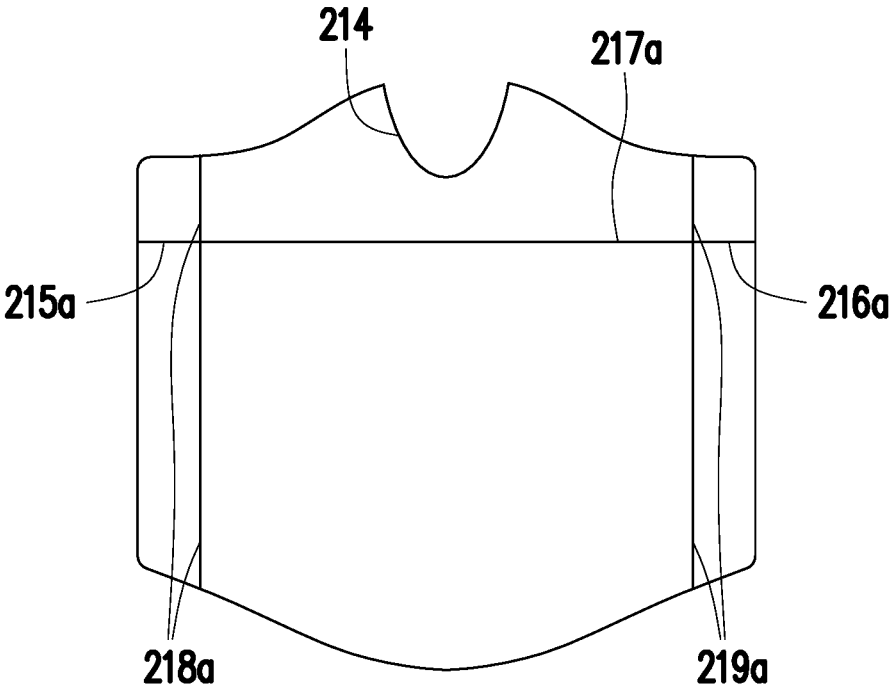
FIG. 9A is a front view of a combination of horizontal pleats and vertical pleats.
Figure 9B:
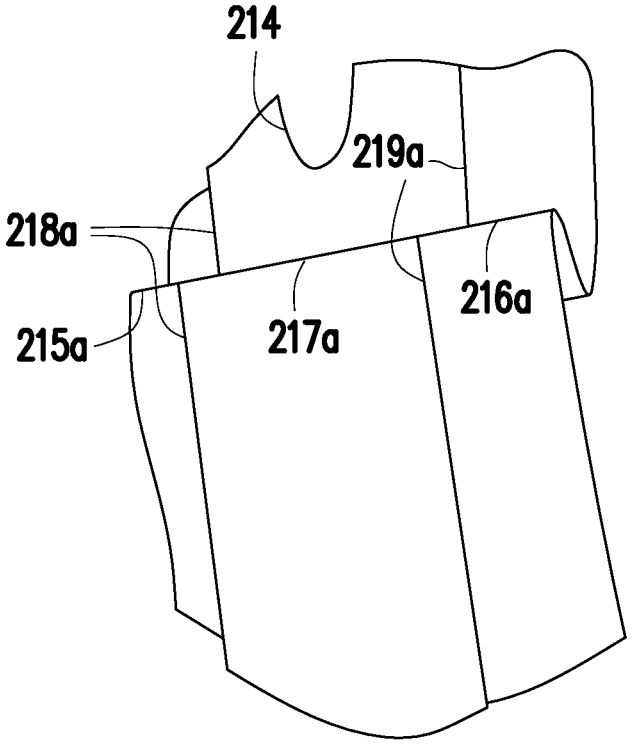
FIG. 9B is a side view of a combination of the horizontal pleats and the vertical pleats.
Figure 9C:
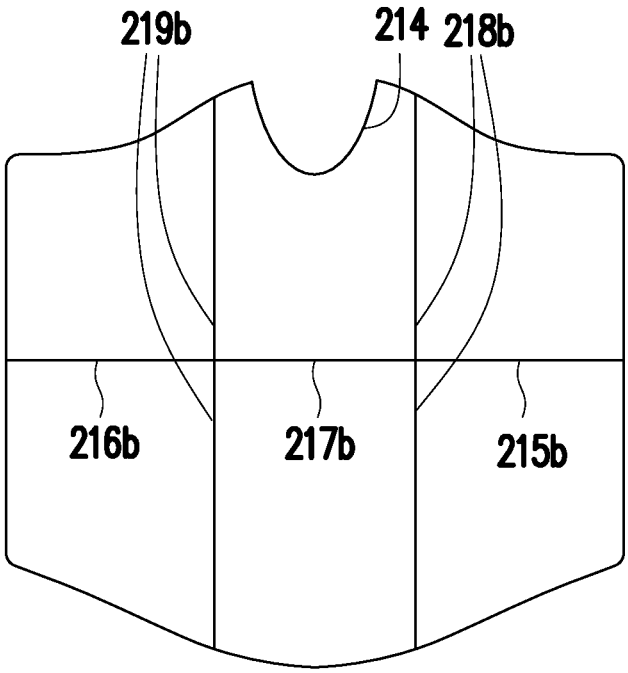
FIG. 9C is a rear view of a combination of a the horizontal pleats and the vertical pleats.

FIG. 9A is a front view of a combination of horizontal pleats 215-217 and vertical pleats 218-219. FIG. 9B is a side view of a combination of the horizontal pleats 215-217 and the vertical pleats 218-219. FIG. 9C is a rear view of a combination of the horizontal pleats 215-217 and the vertical pleats 218-219. To be more clarified, FIGS. 9A-9C represent only the sheet 210.

Please referring to FIGS. 7-8 showing the face mask 200 during a folded mode and FIGS. 9A-9C showing the sheet 210 during the folded mode. The sheet 210 comprises a first horizontal pleat 215, a second horizontal pleat 216, a third horizontal pleat 217, a first vertical pleat 218 and a second vertical pleat 219.

In general, a pleat includes two pleating lines separated by a distance. If one of the pleating line is presented at the front side, another line will be presented at the respectively rear side. As such, the first horizontal pleat 215 forms a front first horizontal pleat 215*a* and a rear first horizontal pleat 215*b*; the second horizontal pleat 216 forms a front second horizontal pleat 216*a* and a rear second horizontal pleat 216*b*; the third horizontal pleat 217 forms a front third horizontal pleat 217*a* and a rear third horizontal pleat 217*b*; the first vertical pleat 218 forms a front first vertical pleat 218*a* and a rear first vertical pleat 218*b*; and the second vertical pleat 219 forms a front second vertical pleat 219*a* and a rear second vertical pleat 219*b*.

As shown in FIGS. 7-9C, third horizontal pleat 217 is laid over the first vertical pleat 218 and the second vertical pleat 219. By the above structure of the sheet 210, both lateral portions of the sheet 210 will be folded near the central portion 213 by the first vertical pleat 218 and the second vertical pleat 219. In addition, the portion of the sheet 210 which is near the opening 214 will be folded closer to the middle.

Figure 10:
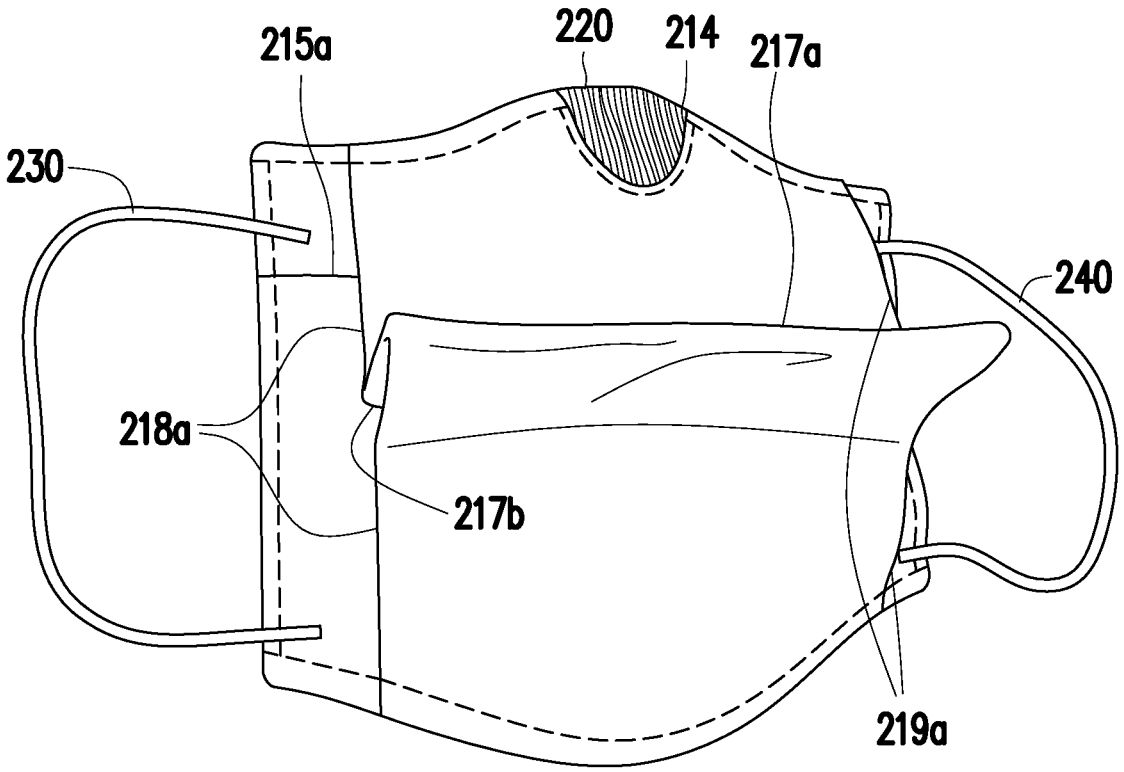
FIGS. 10-12 are views showing the face mask according to the second embodiment during an unfolded mode.
Figure 11:
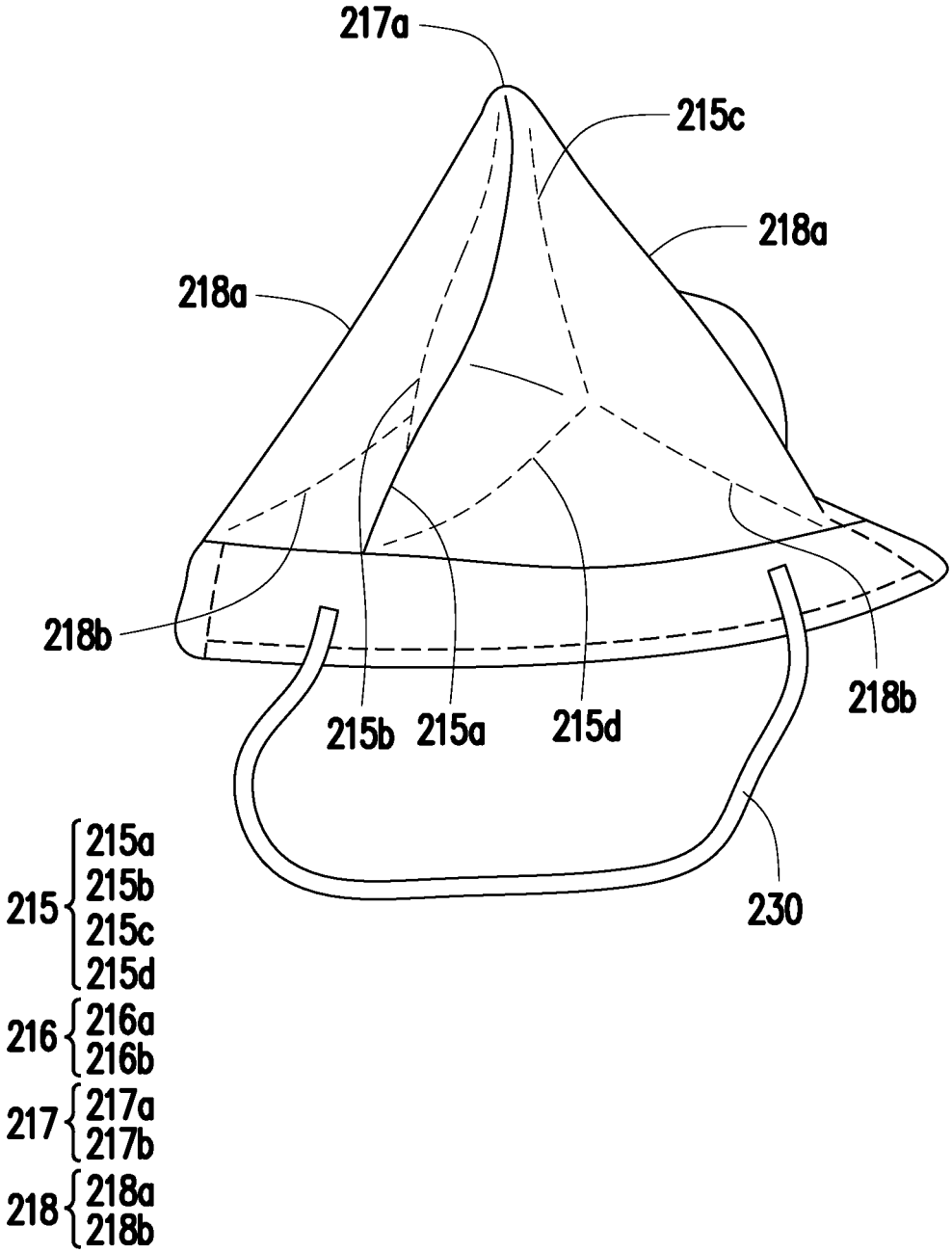
Figure 12:
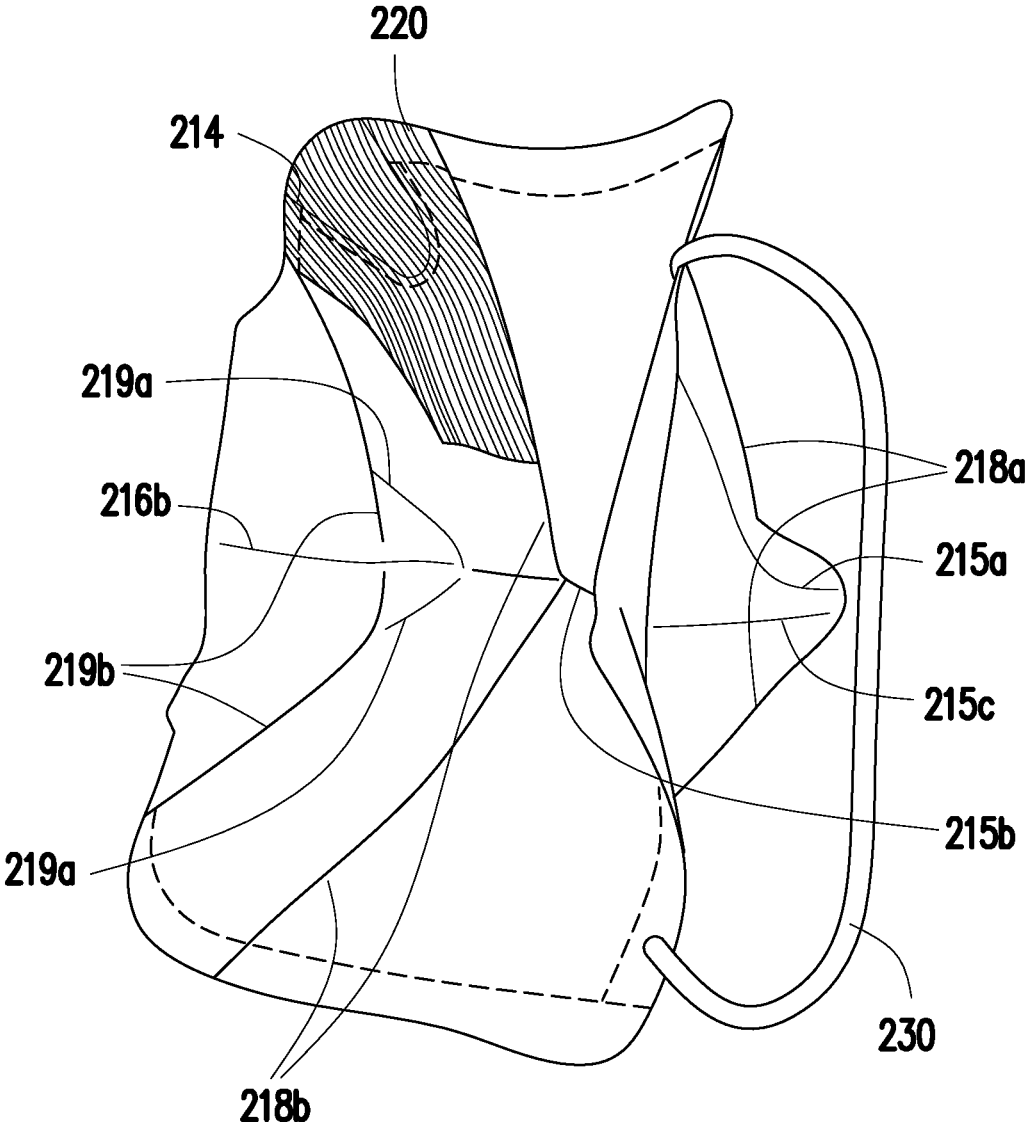
Figure 13:
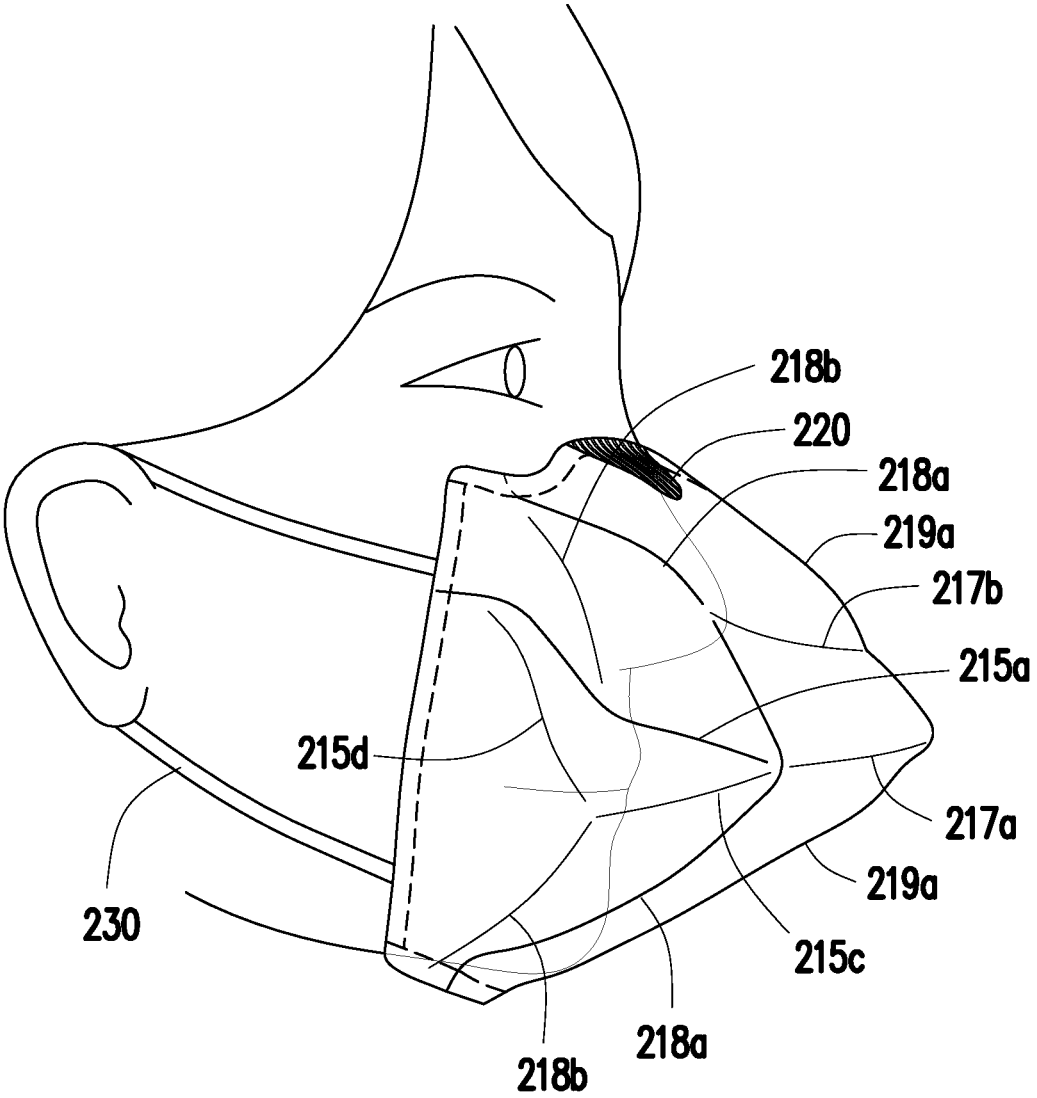
FIG. 13 is a view showing a wearer wears the face mask of the second embodiment.

FIGS. 10-12 are views showing the face mask 200 according to the second embodiment during an unfolded mode. FIG. 13 is a view showing a wearer wears the face mask 200 of the second embodiment.

Referring to FIG. 11-13, one end of the first horizontal pleat 215 and one end of the second horizontal pleat 216 are movable along the front third horizontal pleat 217*a*. Another end of the first horizontal pleat 215 and another end of the second horizontal pleat 216 is fixed at the sheet 210 and located at similar height of the front third horizontal pleat 217*a* as shown in FIG. 7.

When unfolding the face mask 200, the front third horizontal pleat 217*a*, one end of the front first horizontal pleat 215*a* and one end of the front second horizontal pleat 216*a* will be pulled down to be closer to the middle. Therefore, take the first horizontal pleat 215 as an example, an oblique pleat 215*c* and an oblique pleat 215*d* will be formed if keeping folding and unfolding the face mask 200 since the location of another end of the front first horizontal pleat 215*a* is fixed at the sheet 210.

As such, when unfolding the face mask 200, the first horizontal pleat 215 and a second horizontal pleat 216 may form triangular cone structures as shown in FIG. 11 and FIG. 13. For example, one of the triangular cone structure is formed by the front first horizontal pleat 215*a*, the oblique pleat 215*c* and the oblique pleat 215*d* near the first edge 211. These triangular cone structures, near the first edge 211 and the second edge 212, separate the first vertical pleat 218 and the second vertical pleat 219 respectively.

During the unfolded mode, the first vertical pleat 218 is divided into an upper first vertical pleat and a lower first vertical pleat by the first horizontal pleat 215 and the third horizontal pleat 217; the second vertical pleat 219 is divided into an upper second vertical pleat and a lower second vertical pleat by the second horizontal pleat 216 and the third horizontal pleat 217.

Specifically, during the unfolded mode, the upper first vertical pleat and the lower first vertical pleat are connected but not parallel at front side (front first vertical pleat 218*a*). In addition, the upper second vertical pleat and the lower second vertical pleat are connected but not parallel at front side too (front second vertical pleat 219*a*).

In addition, the upper first vertical pleat and the lower first vertical pleat are not directly connected and not parallel at rear side (rear first vertical pleat 218*b*). Similarly, the upper second vertical pleat and the lower second vertical pleat are not directly connected and not parallel at rear side either (rear second vertical pleat 219*b*).

Figure 14:
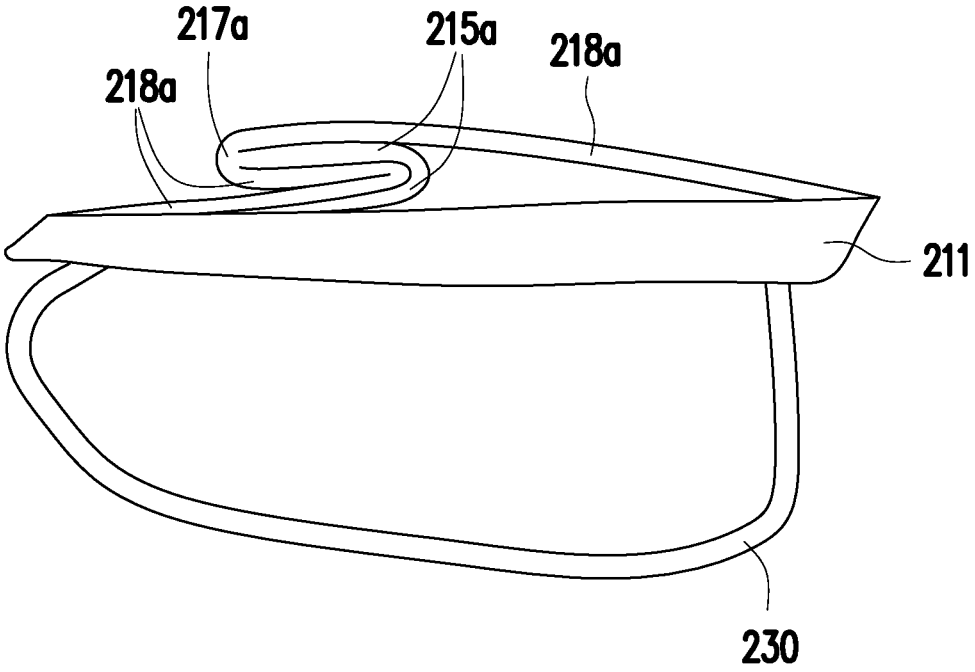
FIG. 14 is a view showing the face mask according to the second embodiment during a folded mode.

FIG. 14 is a view showing the face mask 200 according to the second embodiment during a folded mode.

As shown in FIG. 14 and referring to FIG. 13, when folding back the face mask 200 from the unfolded mode, the oblique pleat 215*c* and the oblique pleat 215*d* will be hidden.

Figure 15A:
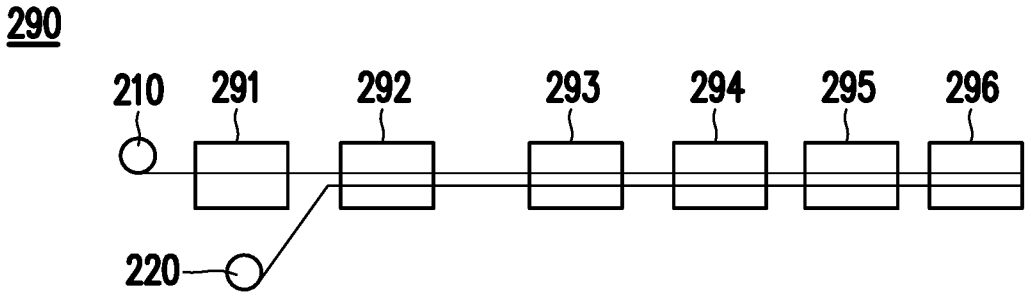
FIGS. 15A-15B are views showing a method of manufacturing the face mask of the second embodiment.
Figure 15B:
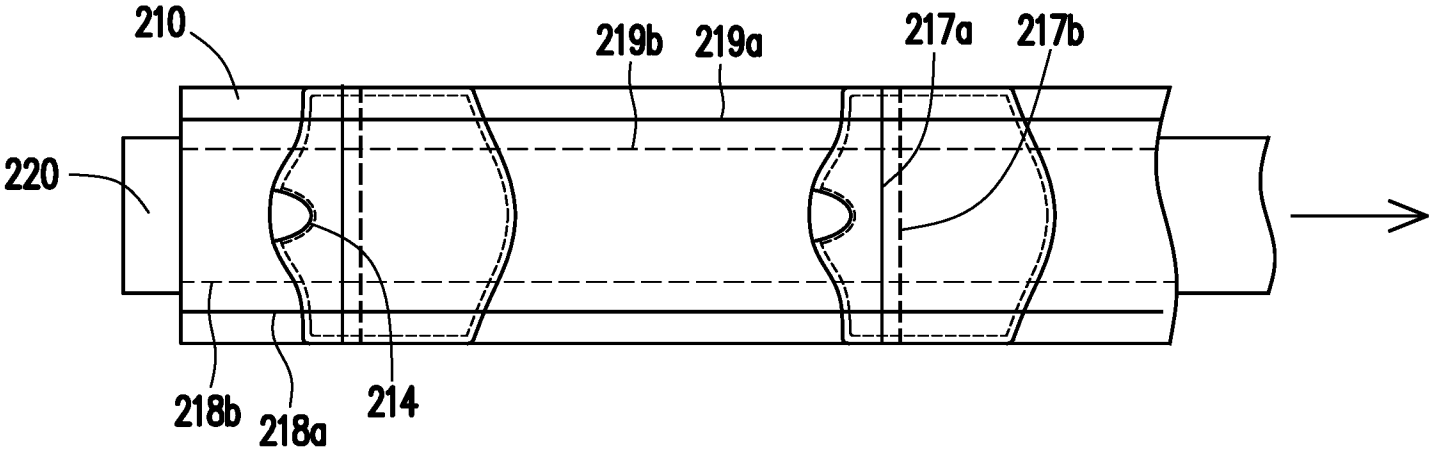

FIGS. 15A-15B are views showing a method of manufacturing the face mask of the second embodiment.

Referring to FIGS. 7-8 and 15A-15B, a system 290 comprises a die cut station 291, a pleating station 292, a pleating station 293, a bonding station 294, a bonding station 295 and a die-cut station 296.

First, preparing the material of the sheet 210 and passing it to the die-cut station 291 to form the opening 214. Second, preparing the material of the elastic film 220 and passing it with the material of the sheet 210 for the next step.

Next, pleating the material of the sheet 210 to form the first vertical pleat 218*a*/218*b* and the second vertical pleat 219*a*/219*b* via the pleating station 292. After that, pleating the material of the sheet 210 to form the first horizontal pleat 215 (referring to FIGS. 7-8), the second horizontal pleat 216 (referring to FIGS. 7-8) and the third horizontal pleat 217*a*/217*b* via the pleating station 293. It should be noted that when passing through the pleating station 292 and the pleating station 293, the material of the elastic film 220 may also be pleated if the material elastic film 220 covers the to-be pleated portion.

After finishing pleating, coupling the material of the sheet 210 and the material of the elastic film 220 together via the bonding station 294. The layout of all material is shown in FIG. 15B as an example. A direction of arrow shown in FIG. 15B means the direction of entering the bonding station 294.

Next, coupling the first loop 230 and the second loop 240 by the bonding station 295. Last, cutting the extra material from the material of the sheet 210 and the material of the elastic film 220 via the die-cut station 296.

Based on the above, the present application allows wearer to have better fit of the face mask 100/200 over the face since the opening 114/214 of the sheet 110/210 and the elastic film 120/220 can provide a flexible structure for the nose.

In addition, according to the face mask 100 of the first embodiment, there is no gap between the face mask 100 and cheek since the first chamber 170 and the second chamber 180 may be deformed along with the facial muscle movement. As such, a sealed space is formed between the face mask 100 and the face.

Furthermore, according to the face mask 200 of the second embodiment, the horizontal pleats 215-217 and the vertical pleats 218-219 can create a bigger space for breathing. In addition, a better seal may be formed since the first loop 230 and the second loop 240 are coupled to opposite edges 211/212 of the sheet 210, and may bring close of the face and all edges of the face mask 200. Also, there is no gap between the face mask 200 and cheek since a snug three dimensional structure is generated during unfolded mode of the face mask 200.

Moreover, the manufacturing rate and cost of face masks are critical for the face mask industry. The methods of manufacturing the face mask 100 and the face mask 200 provide similar manufacturing speeds and costs to those of the general face masks.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A face mask comprising:

a sheet comprising a central portion, a first lateral portion, a second lateral portion and an opening;

a first loop coupled to the sheet;

a second loop coupled to the sheet;

an elastic film coupled to the sheet and covering the opening;

a first lateral flap coupled to the first lateral portion to form a first chamber; and a second lateral flap coupled to the second lateral portion to form a second chamber.

2. The face mask as claimed in claim 1, wherein the opening is semi-elliptical.

3. The face mask as claimed in claim 1, wherein a widest width of the opening is greater than or equal to 0.25 inches.

4. The face mask as claimed in claim 1, wherein a longest length of the opening, is greater than or equal to 0.25 inches.

5. The face mask as claimed in claim 1, wherein the sheet further comprises an outer surface and an inner surface, the elastic film is coupled to the inner surface.

6. The face mask as claimed in claim 1, wherein the elastic film is configured to be stretched in at least one direction.

7. The face mask as claimed in claim 6, wherein at least one portion of the elastic film has a yield point elongation of greater than or equal to 5% in the at least one direction.

8. The face mask as claimed in claim 1, wherein an elasticity of the elastic film is less than or equal to 1 psi.

9. The face mask as claimed in claim 1, wherein the elastic film is extended from the first lateral portion to the second lateral portion.

10. The face mask as claimed in claim 1, wherein the first lateral flap and the second lateral flap comprise a filtering material or a non-breathable material.

11. The face mask as claimed in claim 1, wherein an upper most portion of the opening comprises a first end and a second end, a distance between the first lateral flap and the first end is greater than 0 inch, and a distance between the second lateral flap and the second end is greater than 0 inch.

12. The face mask as claimed in claim 1, wherein the first loop is coupled to the sheet via coupling to the first lateral flap, the second loop is coupled to the sheet via coupling to the second lateral flap.

13. The face mask as claimed in claim 1, wherein a corner of the first lateral portion closer to the opening and a corner of the second lateral portions closer to the opening are curved.

14. A method of manufacturing the face mask of claim 1, comprising:

cutting the sheet to form the opening;

coupling the elastic film to the sheet; and coupling the first loop and the second loop to the sheet.

15. The method of manufacturing the face mask as claimed in claim 14, wherein after coupling the elastic film to the sheet, the method further comprises:

coupling the first lateral flap to the first lateral portion to form the first chamber;

coupling the second lateral flap to the second lateral portion to form the second chamber; and cutting the sheet to make a corner of the first lateral portion closer to the opening and a corner of the second lateral portion closer to the opening be curved.

* * * * *